US009950210B2

(12) United States Patent
Meredith et al.

(10) Patent No.: US 9,950,210 B2
(45) Date of Patent: Apr. 24, 2018

(54) LEG CURL EXERCISE MACHINE INCLUDING A MOVING SUPPORT FOR PERFORMING PRONE LEG CURL EXERCISES

(71) Applicant: Hoist Fitness Systems, Inc., Poway, CA (US)

(72) Inventors: Jeffrey O. Meredith, Del Mar, CA (US); Bruce Hockridge, San Diego, CA (US); Thao V. Doan, Oak Park, CA (US)

(73) Assignee: HOIST FITNESS SYSTEMS, INC., Poway, CA (US)

( * ) Notice: Subject to any disclaimer, the term of this patent is extended or adjusted under 35 U.S.C. 154(b) by 0 days.

(21) Appl. No.: 14/978,399

(22) Filed: Dec. 22, 2015

(65) Prior Publication Data

US 2016/0184630 A1 Jun. 30, 2016

Related U.S. Application Data

(60) Provisional application No. 62/096,685, filed on Dec. 24, 2014.

(51) Int. Cl.

| | |
|---|---|
| ***A63B 21/00*** | (2006.01) |
| ***A63B 23/04*** | (2006.01) |
| ***A63B 21/062*** | (2006.01) |
| ***A63B 22/00*** | (2006.01) |
| ***A63B 22/20*** | (2006.01) |
| ***A63B 23/02*** | (2006.01) |
| ***A63B 23/035*** | (2006.01) |

(52) U.S. Cl.

CPC .... *A63B 23/0494* (2013.01); *A63B 21/00065* (2013.01); *A63B 21/063* (2015.10); *A63B 21/0628* (2015.10); *A63B 21/155* (2013.01); *A63B 21/4011* (2015.10); *A63B 21/4031* (2015.10); *A63B 21/4033* (2015.10); *A63B 21/4034* (2015.10); *A63B 21/4035* (2015.10); *A63B 21/4047* (2015.10); *A63B 21/4049* (2015.10); *A63B 22/0087* (2013.01); *A63B 22/203* (2013.01); *A63B 23/0211* (2013.01); *A63B 23/0216* (2013.01); *A63B 23/0222* (2013.01); *A63B 23/0233* (2013.01); *A63B 23/0238* (2013.01); *A63B 23/03566* (2013.01); *A63B 2225/09* (2013.01); *A63B 2225/093* (2013.01); *A63B 2225/102* (2013.01)

(58) Field of Classification Search

CPC ..... A63B 23/03525; A63B 23/0494; A63B 23/0482; A63B 21/0628; A63B 21/0626; A63B 21/4047; A63B 21/159; A63B 21/4031

See application file for complete search history.

(56) References Cited

U.S. PATENT DOCUMENTS 326,247 A * 9/1885 Root ..... A63B 21/00178 482/131
5,672,143 A * 9/1997 Ish, III ..... A63B 23/0494 482/137

* cited by examiner

*Primary Examiner* — Loan H Thanh
*Assistant Examiner* — Rae Fischer
(74) *Attorney, Agent, or Firm* — Gordon Rees Scully Mansukhani LLP; David R. Heckadon

(57) ABSTRACT

An exercise machine for performing prone leg curl exercises, including a moving support platform or frame that allows a user to perform prone leg curl exercises without excessively arching his or her lower back.

27 Claims, 10 Drawing Sheets

LEG CURL EXERCISE MACHINE INCLUDING A MOVING SUPPORT FOR PERFORMING PRONE LEG CURL EXERCISES

CROSS-REFERENCE TO RELATED APPLICATIONS

The application claims the benefit of provisional U.S. patent application Ser. No. 62/096,685, which was filed in the U.S. Patent and Trademark Office on Dec. 24, 2014. Application Ser. No. 62/096,685 is incorporated herein by reference in its entirety.

STATEMENT REGARDING FEDERALLY SPONSORED RESEARCH OR DEVELOPMENT

This application is not the subject of any federally sponsored research or development.

THE NAMES OF THE PARTIES TO A JOINT RESEARCH AGREEMENT

There have been no joint research agreements entered into with any third parties.

FIELD OF THE INVENTION

The present invention generally relates to fitness equipment. Specifically, the embodiments of the present invention are directed to an exercise machine for performing prone leg curl exercises, including a moving support platform or frame that allows a user to perform prone leg curl exercises without excessively arching his or her lower back.

BACKGROUND OF THE INVENTION

Traditional leg curl exercise machines include a stationary platform or frame for supporting the user's upper torso while the user performs prone leg curl exercises. These traditional leg curl exercise machines support the upper torso in a relatively fixed position while the user's lower legs move in an arcuate path from an exercise starting position to an exercise ending position (and often back to the exercise start position). Because the traditional leg curl exercise machine supports the user's upper torso in a relatively fixed position, the movement associated with the user's lower body often results in excessive arching of the lower back, particularly when the user's lower legs are in the exercise ending position. Excessive arching of the lower back can lead to lower back pain, strain, or other associated injury.

Consequently, a need exists for a leg curl exercise machine that maintains the user's body in a more ergonomically sound position throughout the exercise motion. The embodiments of the present invention solve this problem by providing a leg curl exercise machine that includes a moving support platform or frame to support the user's upper torso. The moving support platform or frame may include a linkage assembly that allows the moving support platform or frame to tilt as the user performs a prone leg curl exercise. Other advantages of the present invention will become apparent to one skilled in the art.

SUMMARY OF THE INVENTION

An embodiment of the present invention is directed to an exercise machine for performing prone leg curl exercises, the exercise machine including a main frame coupled to a stationary thigh pad; an exercise arm pivotally connected to the main frame that moves in an arcuate path from an exercise starting position to an exercise ending position; a source of resistance associated with the exercise arm, which may be a selectorized weight stack assembly and which biases the exercise arm toward the exercise starting position; a moving support platform pivotally connected to the main frame that is configured to support a user's upper torso, which may include a chest pad; and a connecting link assembly pivotally connected to the exercise arm and to the moving support platform or frame, which may be a four-bar linkage and which translates movement of the exercise arm into a tilting or lowering movement of the moving support platform.

Another embodiment of the present invention is directed to an exercise machine for performing prone leg curl exercises, the exercise machine including a main frame coupled to a stationary thigh pad; an exercise arm pivotally connected to the main frame that moves in an arcuate path from an exercise starting position to an exercise ending position; a source of resistance associated with the exercise arm, which may be a selectorized weight stack assembly and which biases the exercise arm toward the exercise starting position; a moving support frame pivotally connected to the main frame that is configured to support a user's upper torso, which may include an arm rest support frame; and a connecting link assembly pivotally connected to the main frame, to the exercise arm, and to the moving support platform or frame, which may be a four-bar linkage and which translates movement of the exercise arm into a tilting or lowering movement of the moving support frame.

Yet another embodiment of the present invention is directed to an exercise machine for performing prone leg curl exercises, the exercise machine including a main frame pivotally connected to a moving thigh support; an exercise arm pivotally connected to the moving thigh support that moves in an arcuate path from an exercise starting position to an exercise ending position; a source of resistance associated with the exercise arm, which may be a selectorized weight stack assembly and which biases the exercise arm toward the exercise starting position; a moving support frame pivotally connected to the moving thigh support that is configured to support a user's upper torso, which may include an arm rest support frame; a connecting link assembly pivotally connecting the exercise arm to the main frame; and a connecting link assembly pivotally connecting the moving support frame to the main frame.

Yet another embodiment of the present invention is directed to an exercise machine for performing prone leg curl exercises, the exercise machine including a main frame pivotally connected to a moving thigh support; an exercise arm pivotally connected to the moving thigh support that moves in an arcuate path from an exercise starting position to an exercise ending position; a source of resistance associated with the exercise arm, which may be a selectorized weight stack assembly and which biases the exercise arm toward the exercise starting position; a moving support frame pivotally connected to the moving thigh support that is configured to support a user's upper torso, which may include an arm rest support frame; a connecting link assembly pivotally connecting the exercise arm to the main frame; and a support roller assembly connecting the moving support frame to the main frame for a sliding, fore-aft movement.

BRIEF DESCRIPTION OF THE DRAWINGS

Preferred features of the embodiments of the present invention are disclosed in the accompanying drawings, wherein similar reference characters denote similar elements throughout the several views, and wherein.

DETAILED DESCRIPTION

Figure 1:
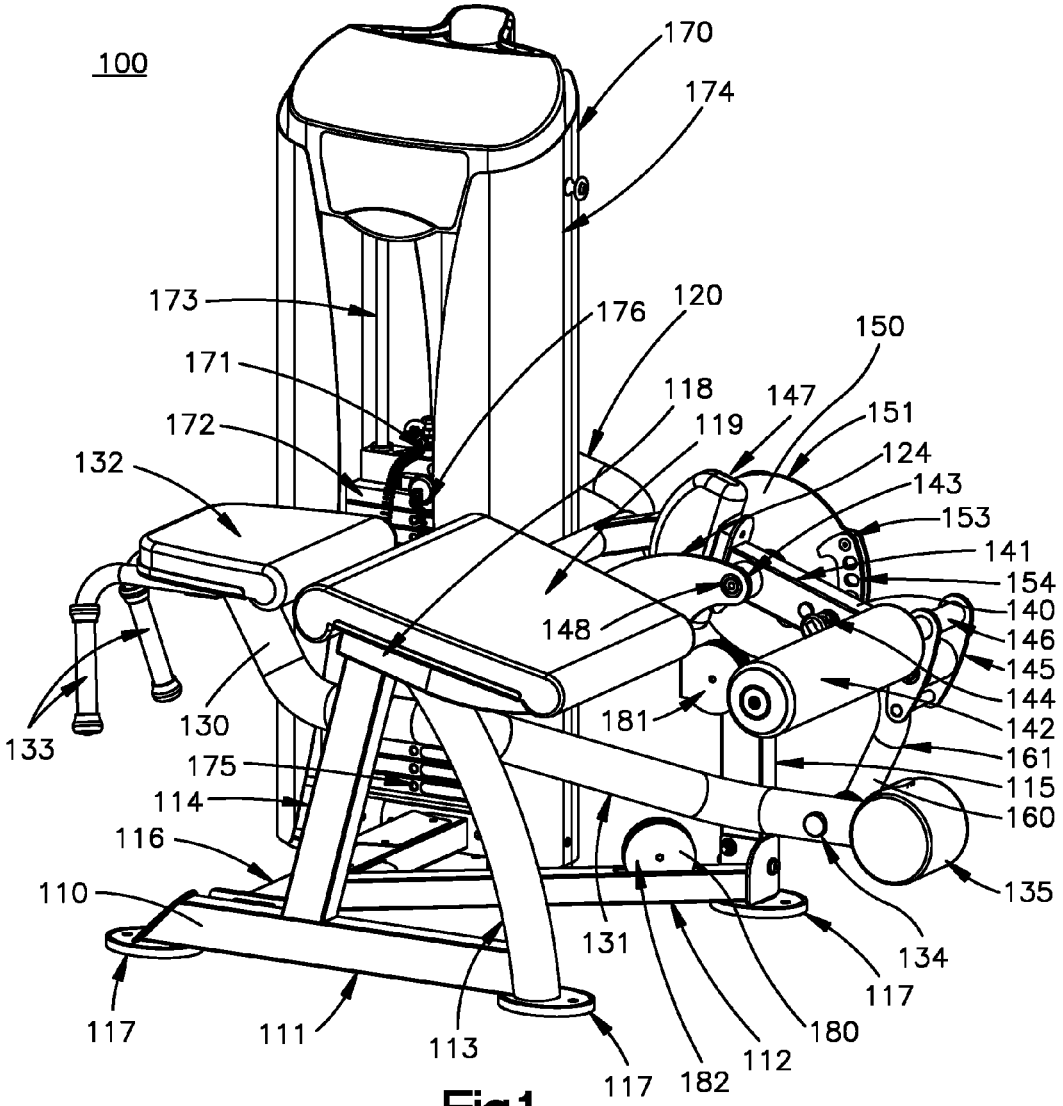
FIG. 1 is an isometric, left-hand view of a leg curl exercise machine including a selectorized weight stack assembly.

The embodiments of the present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete and will convey the scope of the invention to those skilled in the art.

In the following description, like reference characters designate like or corresponding parts throughout the figures. It is to be understood that the phraseology and terminology used in the following description are used for the purpose of description and enablement, and should not be regarded as limiting. Additionally, in the following description, it is understood that terms such as "top," "bottom," "side," "front," "back," "inner," "outer," and the like, are words of convenience and are not to be construed as limiting terms.

A leg curl exercise machine including a moving support for performing prone leg curl exercises is described herein. The embodiments of the present invention are designed to provide a leg curl exercise machine that avoids excessive arching of the lower back by maintaining the user's body in a more ergonomically sound position throughout the exercise motion when a user performs prone leg curl exercises.

Figure 2:
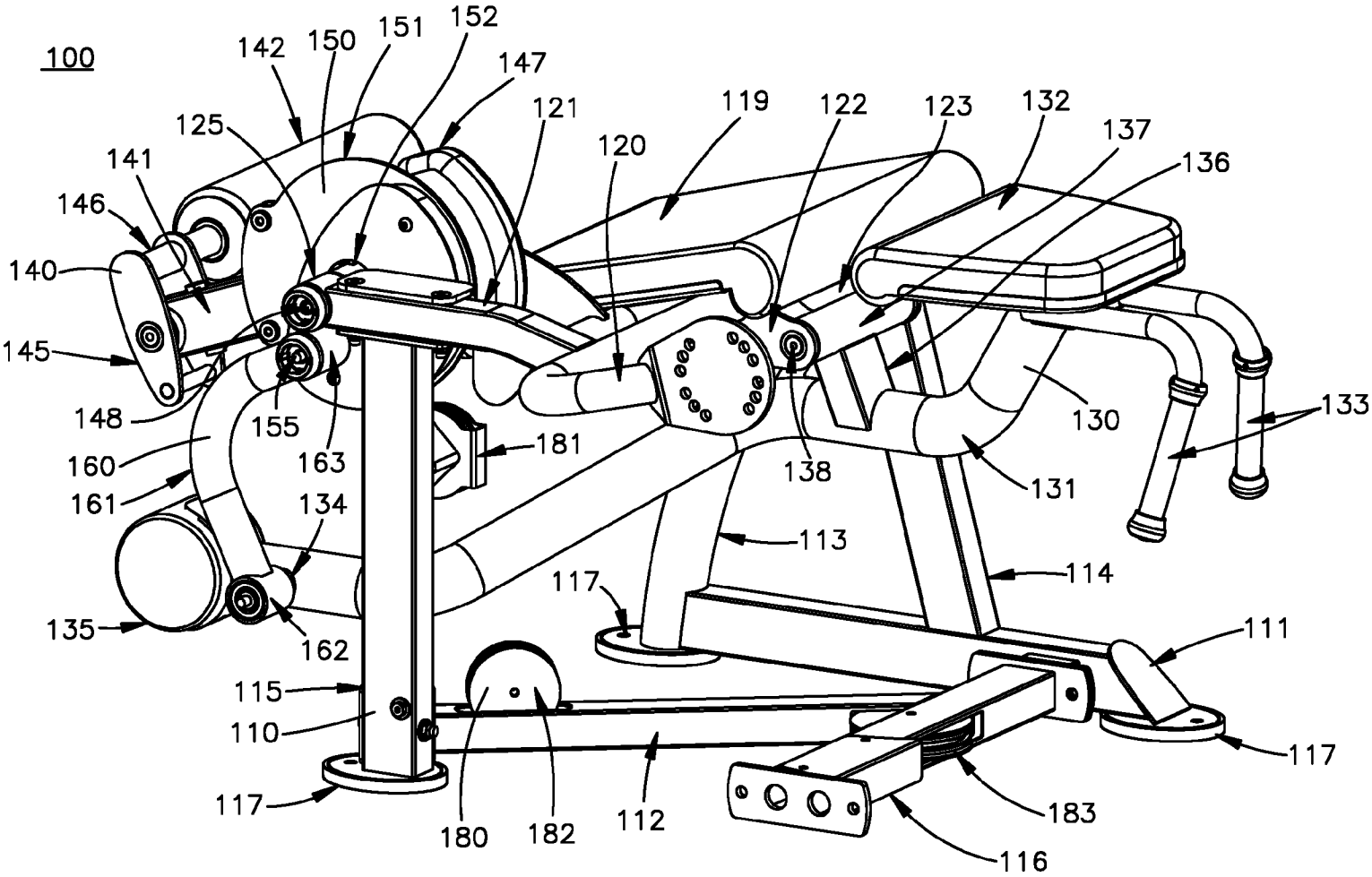
FIG. 2 is an isometric, right-hand view of a leg curl exercise machine as depicted in FIG. 1, with the selectorized weight stack assembly omitted for clarity.
Figure 3:
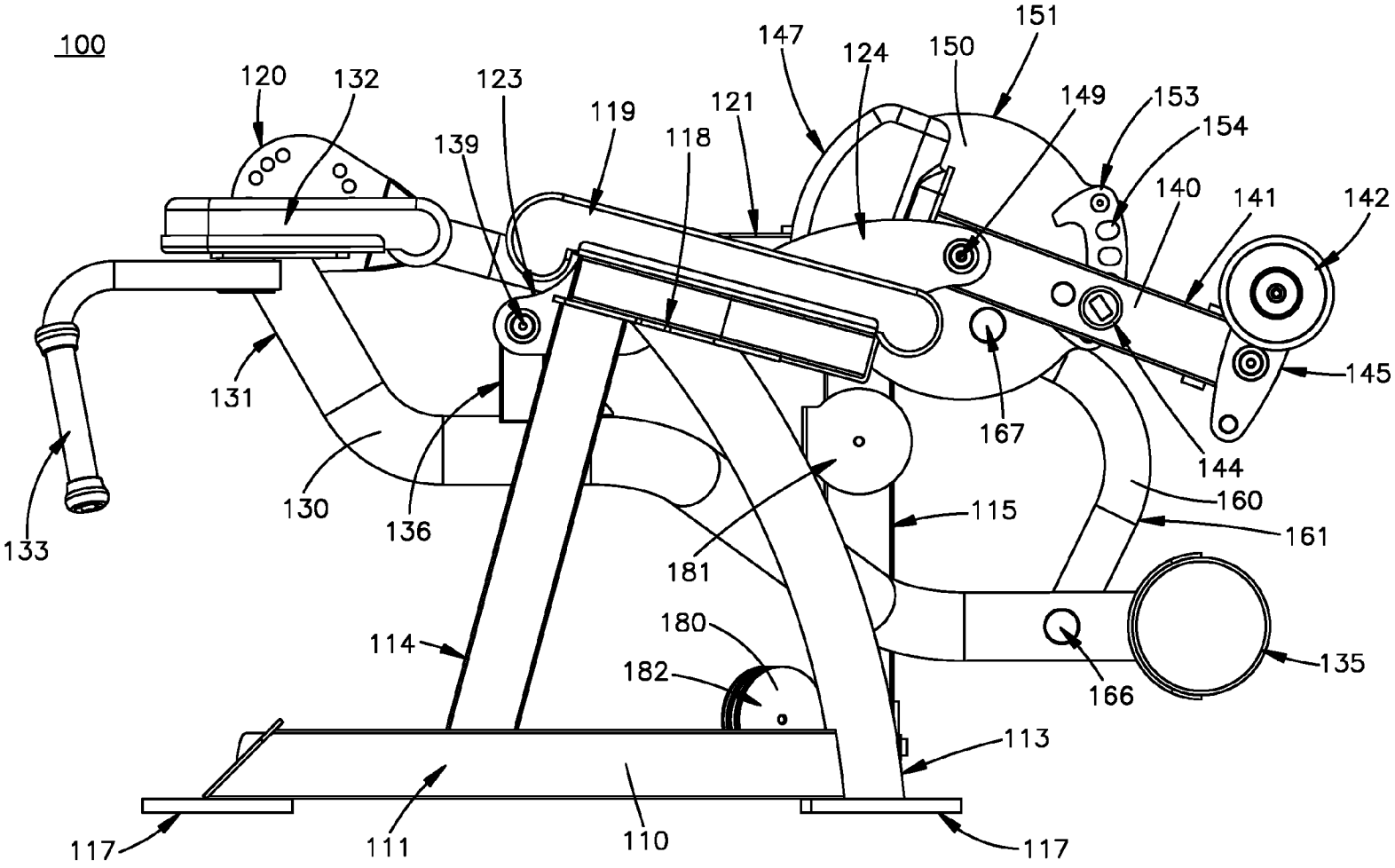
FIG. 3 is a left side view of a leg curl exercise machine as depicted in FIG. 1, with the selectorized weight stack assembly omitted for clarity.
Figure 4:
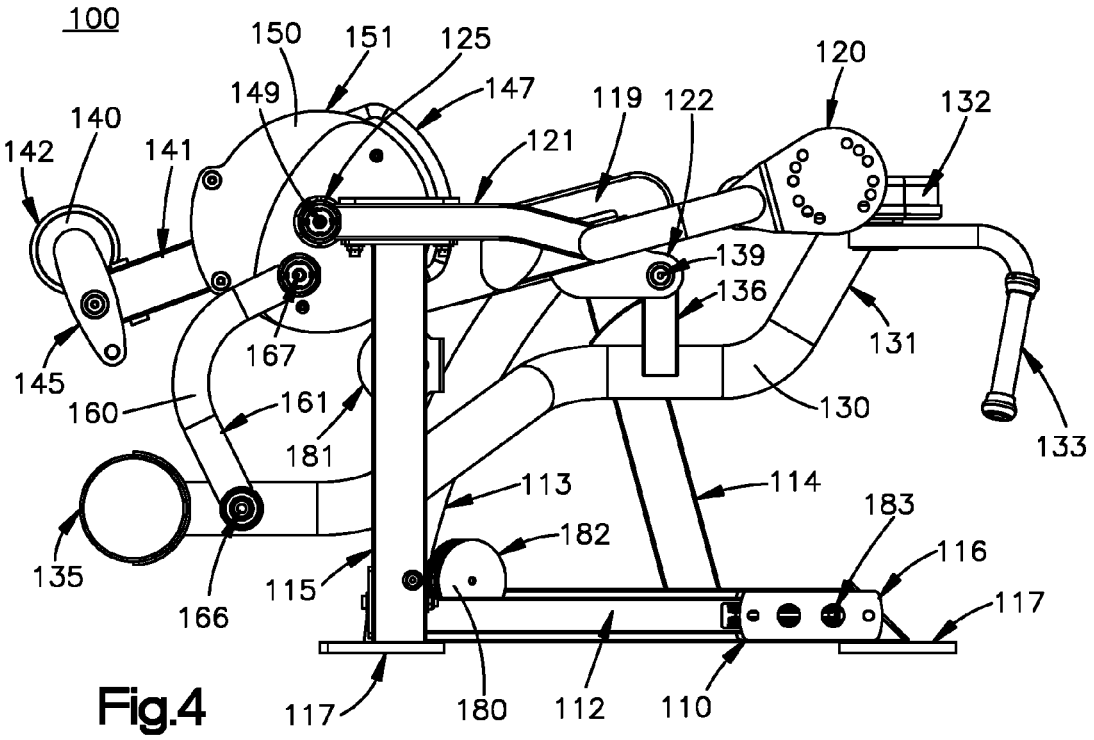
FIG. 4 is a right side view of a leg curl exercise machine as depicted in FIG. 1, with the selectorized weight stack assembly omitted for clarity.
Figure 5:
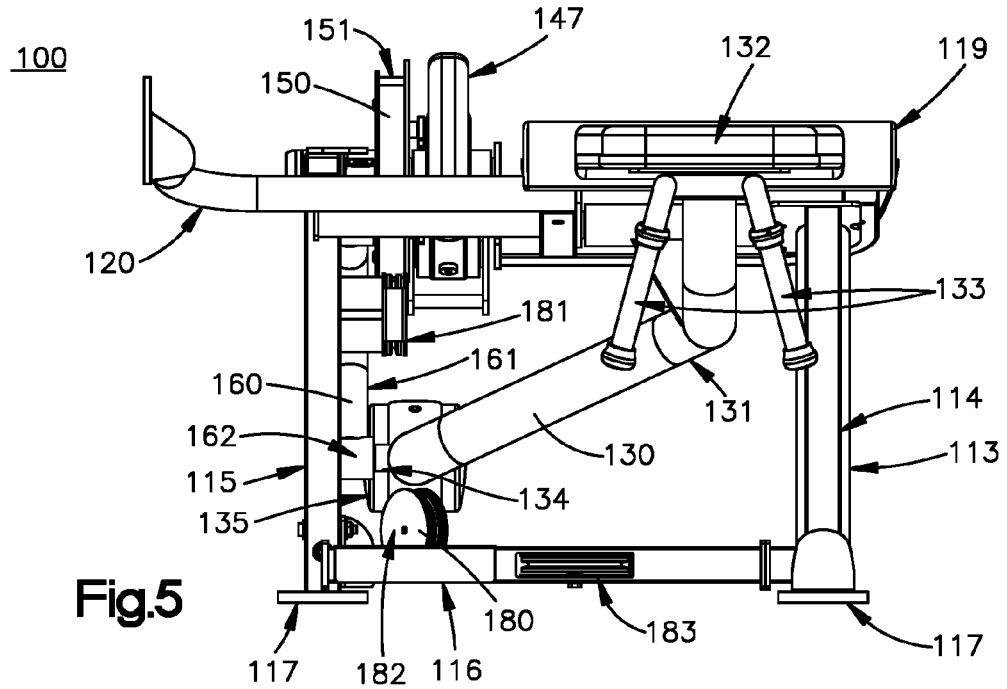
FIG. 5 is a front side view of a leg curl exercise machine as depicted in FIG. 1, with the selectorized weight stack assembly omitted for clarity.
Figure 6:
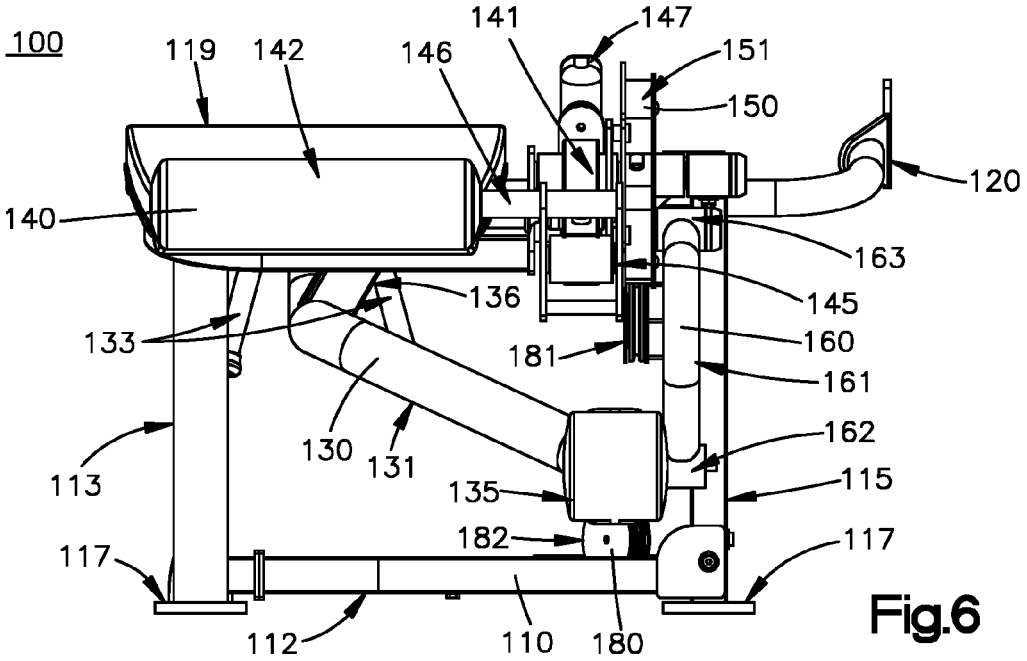
FIG. 6 is a back side view of a leg curl exercise machine as depicted in FIG. 1, with the selectorized weight stack assembly omitted for clarity.
Figure 7:
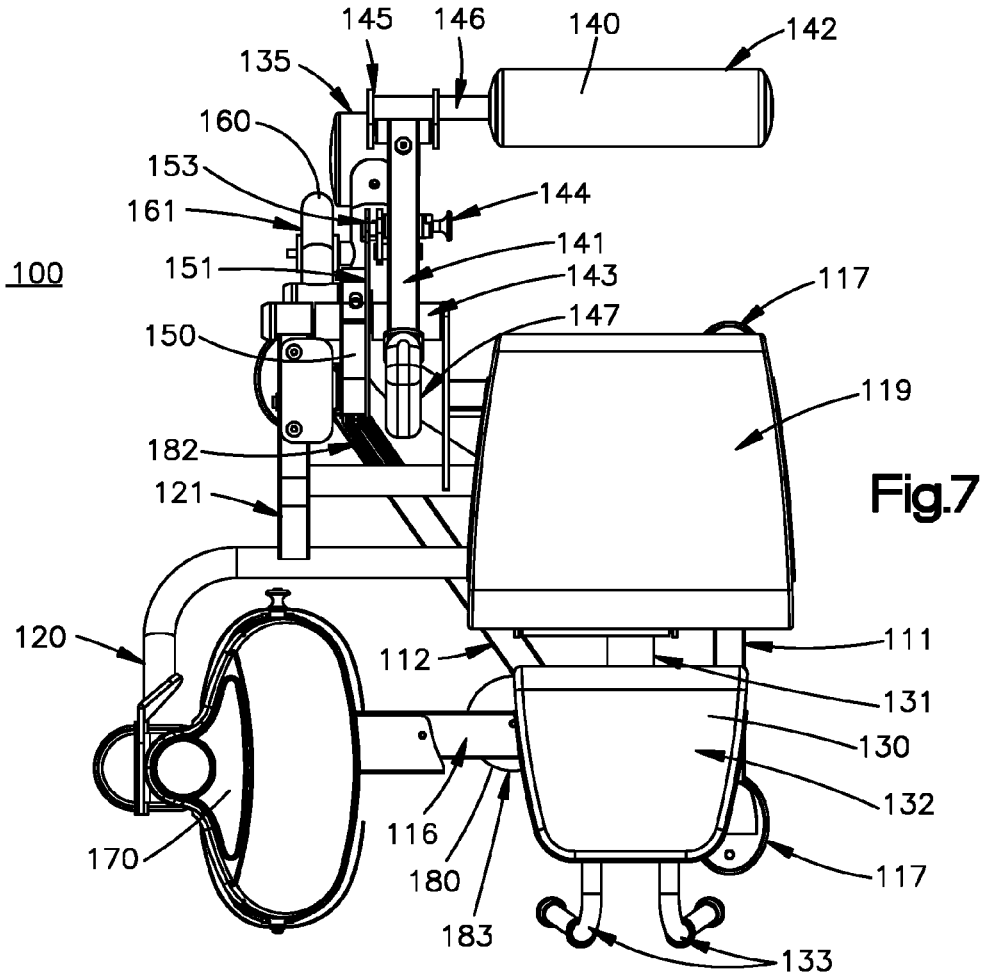
FIG. 7 is a top view of a leg curl exercise machine as depicted in FIG. 1, including the selectorized weight stack assembly.
Figure 8:
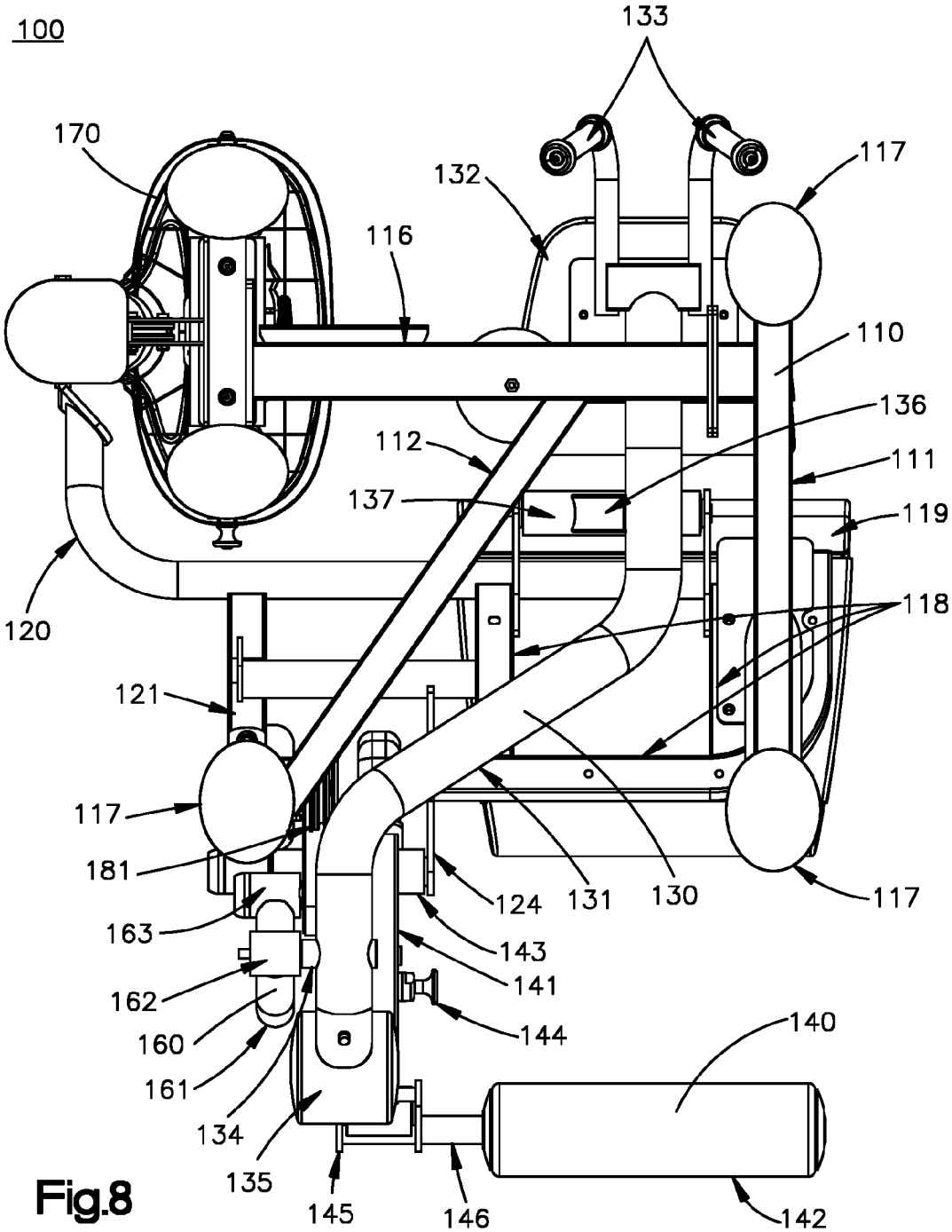
FIG. 8 is a bottom view of a leg curl exercise machine as depicted in FIG. 1, including the selectorized weight stack assembly.

An embodiment of the present invention includes a leg curl exercise machine 100 as depicted in FIGS. 1-10. As best shown in FIGS. 1 and 2, a leg curl exercise machine 100 includes a stationary main frame 110. The main frame 110 is a fixed frame structure and includes a horizontal side strut 111; a horizontal cross strut 112; support uprights 113, 114; a vertical exercise arm support member 115, and a horizontal connecting strut 116. The main frame 110 also includes support feet 117 at both ends of the horizontal side strut 111 and at the end of the horizontal cross strut 112. The main frame 110 includes a thigh pad frame 118 on which a thigh pad 119 is mounted. The main frame 110 further includes, a weight stack support strut 120 (FIG. 2), an exercise arm support strut 121 (FIG. 2), moving support frame pivot brackets 122, 123 (FIGS. 2-4), an exercise arm pivot bracket 124 (FIGS. 1 and 3), and a pivot sleeve 125 (FIGS. 2 and 4). The main frame 110 supports the weight of the user and provides a fixed structure to which all moving assemblies are connected.

The leg curl exercise machine 100, as depicted in FIGS. 1-10, further includes a moving support frame 130 that supports the user's upper torso during performance of a prone leg curl exercise. The moving support frame 130 is a frame structure or platform that includes a moving frame member 131, a chest pad 132, and a pair of handles 133. The handles 133 are positioned forward of the chest pad 132 and angled downwardly and outwardly. The moving frame member 131 includes an axle 134 for pivotally connecting the moving support frame 130 to the connecting link 160, which is further described below. The axle 134 comprises a shaft passing through the frame member 131 and welded into place. However, one skilled in the art will recognize that alternative methods of providing a pivotal connection may be used, and these alternative methods are within the scope of the present invention. The moving support frame 130 further includes a counterweight 135 connected to the moving frame member 131 at an end opposite the chest pad 132 and handles 133. The counterweight 135 balances the moving support frame 130. The counterweight 135 may also lightly bias the moving support frame 130 toward an exercise starting position, which is described in further detail below.

As shown in FIGS. 2 and 3, the moving support frame 130 is pivotally connected to the main frame 110. The moving support frame 130 includes a pivot strut 136 connecting the moving frame member 131 to a pivot sleeve 137. A pivot pin 138 passes through moving support frame pivot brackets 122, 123 on the main frame 110 and through the pivot sleeve 137. The moving support frame 130 is thus pivotally connected to the main frame 110 for rotation about pivot axis 139 (FIGS. 3 and 4).

The leg curl exercise machine 100, as depicted in FIGS. 1-10, further includes an exercise arm assembly 140. The exercise arm assembly 140 includes a rotating exercise arm 141, and at least one roller pad 142. The rotating exercise arm 141 has a pivot sleeve 143 and a pull pin 144 that allows a user to adjust the position and orientation of the exercise arm assembly 140 in the exercise starting position, which is described in further detail below. The rear end of the rotating exercise arm 141 has a roller pad support and pivot bracket 145. A roller pad support rod 146 is connected to the roller pad support and pivot bracket 145 and provides support and mounting for the roller pad 142. The opposite, front end of the rotating exercise arm 141 has a counterweight 147 that balances the exercise arm assembly 140, so that its position and orientation may be more easily adjusted.

The leg curl exercise machine 100 of FIGS. 1-10 further includes a cam assembly 150 associated with the exercise arm assembly 140. The cam assembly 150 includes a cam 151 pivotally mounted on the main frame 110. The cam 151 has an opening 152 for pivotally mounting the cam assembly 150 to the main frame 110. The cam 151 has an exercise arm adjuster 153 with adjustment openings 154 that provide selective adjustment of the position and orientation of the exercise arm assembly 140. The cam 151 also includes an axle 155 for pivotally connecting the cam assembly 150 to the connecting link 160, which is further described below. The axle 155 comprises a shaft passing through the cam 151 and welded into place. However, one skilled in the art will recognize that alternative methods of providing a pivotal connection may be used, and these alternative methods are within the scope of the present invention.

As shown in FIGS. 1-4, the exercise arm assembly 140 and the cam assembly 150 are both pivotally connected to the main frame 110. A pivot pin 148 passes through the exercise arm pivot bracket 124 and the pivot sleeve 125 on the main frame 110, through the pivot sleeve 143 on the rotating exercise arm 141 of the exercise arm assembly 140, and through the opening 152 in the cam 151 of the cam assembly 150. Thus, the exercise arm assembly 140 and the cam assembly 150 are pivotally connected to the main frame 110 for independent rotation about pivot axis 149 (FIGS. 3 and 4).

Though the exercise arm assembly 140 and the cam assembly 150 are pivotally connected for independent rotation about a common pivot axis 149, the pull pin 144 and the adjustment openings 154 in the exercise arm adjuster 153 allow the exercise arm assembly 140 and cam assembly 150 to be selectively coupled together at various orientations for synchronized rotation about pivot axis 149. A user may select from among the adjustment openings 154 and selectively engage or release the pull pin 144 into one or more of the adjustment openings 154 in order to couple the exercise arm assembly 140 to the cam assembly 150. Once coupled, the exercise arm assembly 140 and the cam assembly 150 will rotate together about pivot axis 149. Additionally, the various adjustment openings 154 allow the user to couple the exercise arm assembly 140 to the cam assembly 150 when the exercise arm assembly 140 is in a preferred position and orientation for starting an exercise. That is, the user may engage or release the pull pin 144 into one or more adjustment openings 154 in order to adjust the position and orientation of the exercise arm assembly 140, so that the exercise arm assembly 140, specifically the roller pad 142, is in a preferred position and orientation for the exercise starting position.

As best shown in FIGS. 1-4, the leg curl exercise machine 100 of FIGS. 1-10 further includes a connecting link 160. The connecting link 160 includes a bent member 161 with pivot sleeves 162, 163 on each end thereof. The pivot sleeve 162 at one end of the bent member 161 is pivotally connected to the moving frame member 131 at axle 134. The axle 134 passes through pivot sleeve 162, pivotally connecting the connecting link 160 to the moving support frame 130 for relative rotation about pivot axis 166 (FIGS. 3 and 4). Similarly, the pivot sleeve 163 at the opposite end of the bent member 161 is pivotally connected to the cam 151 at its axle 155. The axle 155 passes through pivot sleeve 163, pivotally connecting the connecting link 160 to the cam assembly 150 for relative rotation about pivot axis 167 (FIGS. 3 and 4).

The leg curl exercise machine 100 further includes a source of resistance, which in the case of the embodiment depicted in FIGS. 1-10 is a selectorized weight stack assembly 170. One of ordinary skill in the art will appreciate, however, that the source of resistance may include, without limitation, a weight stack, weight plates mounted on pegs, or other types of resistance such as hydraulic, pneumatic, electromagnetic, friction, springs, elastically bending rods, elastic bands, or the like. The selectorized weight stack assembly 170 is connected to the main frame 110 at the ends of horizontal connecting strut 116 and weight stack support strut 120. The selectorized weight stack assembly 170 includes a lifting rod 171 operatively connected to a cable (not shown), a plurality of weight plates 172 which are slidingly mounted on guide rods 173 (only one shown) and a housing 174. Lifting rod 171 and weight plates 172 have aligned openings 175 through which a pin 176 can be inserted to connect weight plates 172 to lifting rod 171. When a selected weight plate 172 is connected to lifting rod 171, the selected weight plate 172, and any weight plates above the selected weight plate 172, will be lifted with the lifting rod 171.

The leg curl exercise machine 100 depicted in FIGS. 1-10 further includes a pulley assembly 180 that transmits the resistance provided by the selectorized weight stack assembly 170 to the exercise arm assembly 140, biasing the exercise arm assembly 140 toward an exercise starting position. In the depicted embodiment, the pulley assembly 180 includes a cable (not shown) anchored at a first end to the cam 151. The cable extends around a first pulley 181 mounted on the vertical exercise arm support member 115 and a second pulley 182 mounted on the horizontal cross strut 112. The cable then extends through a hollow in the horizontal cross strut 112 and around a third pulley 183 mounted on the horizontal connecting strut 116. The cable then extends through a hollow in the horizontal connecting strut 116 and its second end is directly or indirectly connected to the lifting rod 171 of the selectorized weight stack assembly 170. Thus, when the exercise arm assembly 140 and the cam assembly 150 are coupled to rotate together, movement of the exercise arm assembly 140 from the exercise starting position to the exercise ending position, as described below, causes the cable (not shown) of the pulley assembly 180 to pull the lifting rod 171 of the selectorized weight stack assembly 170, which in turn lifts the selected weight plate 172 and any weight plates above the selected weight plate 172.

Figure 9:
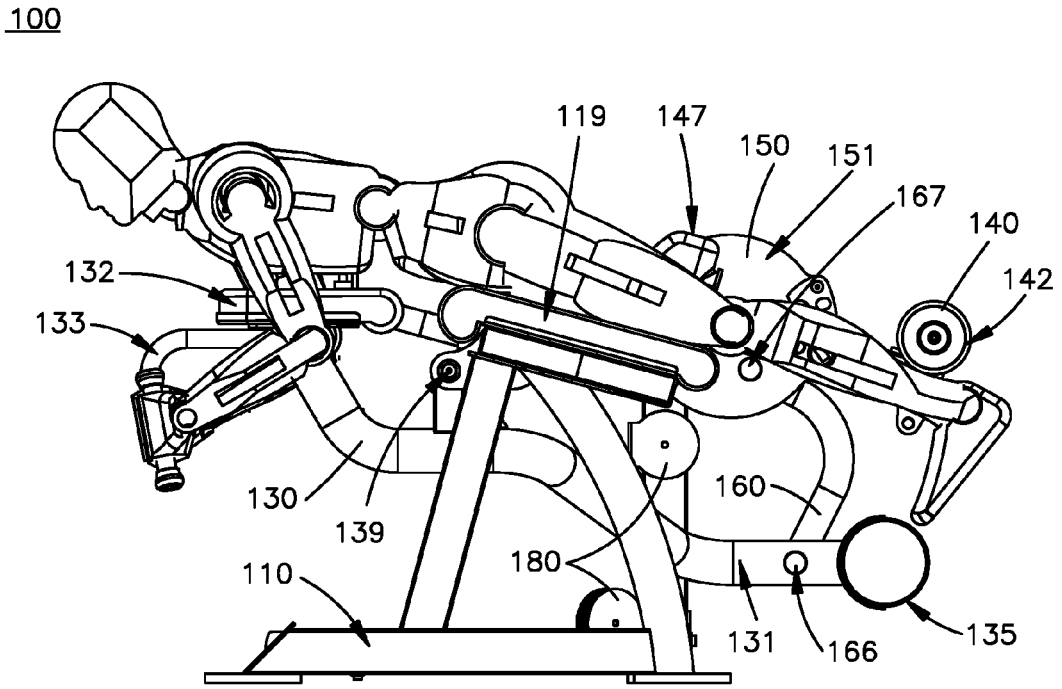
FIG. 9 is a left side view of a leg curl exercise machine as depicted in FIG. 1, including a user in the exercise starting position, with the selectorized weight stack assembly omitted for clarity.
Figure 10:
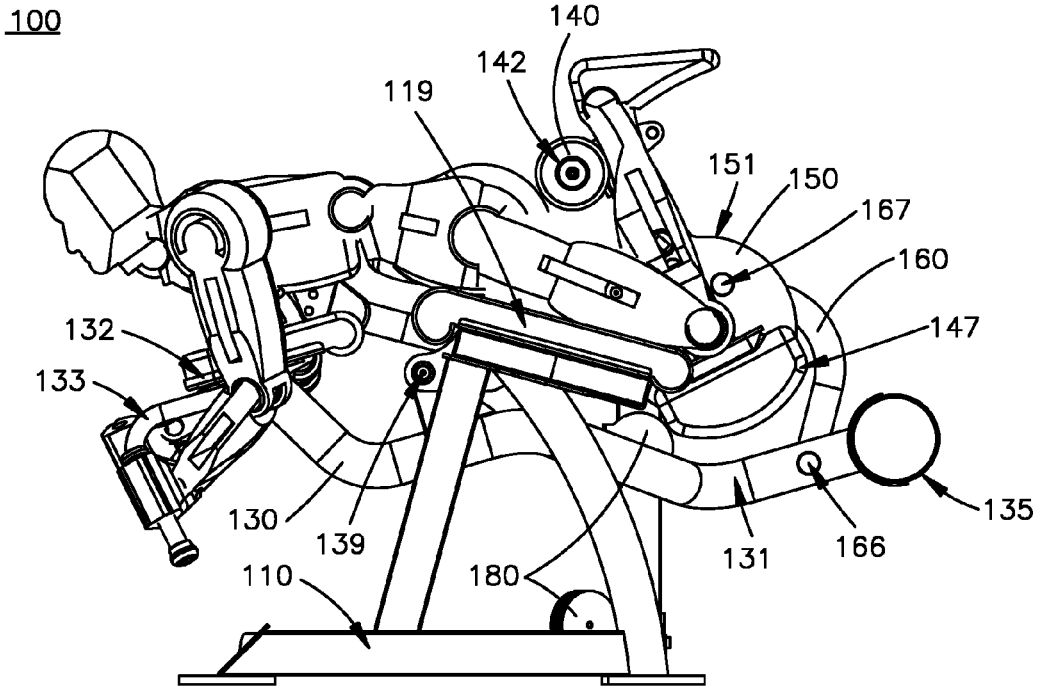
FIG. 10 is a left side view of a leg curl exercise machine as depicted in FIG. 1, including a user in the exercise ending position, with the selectorized weight stack assembly omitted for clarity.

The operation and use of the embodiment depicted in FIGS. 1-10 will now be described with specific reference to FIGS. 9 and 10. FIG. 9 shows the depicted embodiment in an exercise starting position, with a user prepared to perform a prone leg curl exercise. The user is in a face-down, prone position with his thighs engaging and being supported by the thigh pad 119, which is mounted to the main frame 110. The user's upper torso is supported by the chest pad 132 and the handles 133. The backs of the user's lower legs engage the roller pad 142. As described above, the exercise arm assembly 140 may be adjusted to achieve a preferred position and orientation for the exercise starting position of the roller pad 142. Accordingly, when performing a prone leg curl exercise, the exercise arm assembly 140 is coupled to the cam assembly 150, as previously described.

The user begins by using his lower legs to exert a force on the roller pad 142. In response, the roller pad 142 moves upwardly and forwardly in an arcuate path as the exercise arm assembly 140 and the cam assembly 150 rotate together about pivot axis 149 (FIGS. 3 and 4). As the cam 151 rotates about pivot axis 149, it lifts connecting link 160, which is pivotally connected to the cam 151 at pivot axis 167. As the connecting link 160 moves upward, it lifts the rear (counterweighted) end of moving frame member 131, which is pivotally connected to the connecting link at pivot axis 166. As the rear end of moving frame member 131 moves upward, the entire moving support frame 130 tilts as it rotates about pivot axis 139. Thus, the front end of the moving support frame 130, including the chest pad 132 and handles 133, dips lower as the user completes a prone leg curl exercise, finishing in the exercise ending position shown in FIG. 10. As shown in FIG. 10, the user's upper torso moves downward as the chest pad 132 and handles 133 dip lower, thus avoiding any excessive arching or stressing of the user's lower back.

As described with more detail above, as the exercise arm assembly 140 and the cam assembly 150 rotate together about pivot axis 149, the cam 151 pulls on the cable (not shown) of the pulley assembly 180, which is connected to the selectorized weight stack assembly 170. Furthermore, the counterweights 135, 147 balance the respective moving assemblies, i.e. the moving support frame 130 and the exercise arm assembly 140. Accordingly, the amount of resistance that biases the exercise arm assembly 140 toward the exercise starting position is almost entirely determined by the amount of weight selected in the selectorized weight stack assembly 170. That is, the user experiences substantially zero additional resistance throughout the exercise motion.

Figure 11:
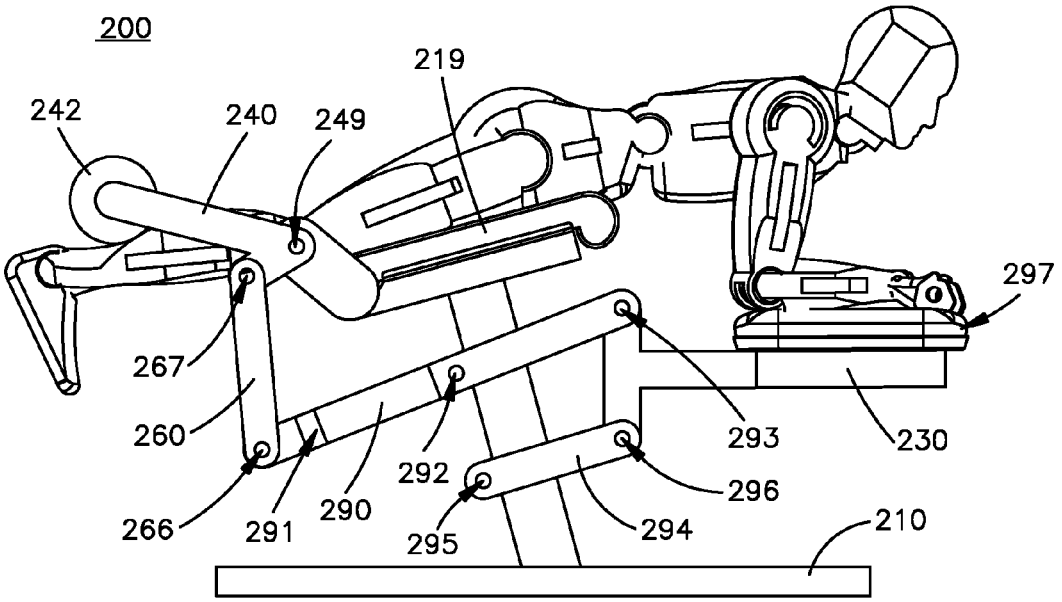
FIG. 11 is a right side view of an alternative embodiment of a leg curl exercise machine, including a user in the exercise starting position, with the selectorized weight stack assembly omitted for clarity.
Figure 12:
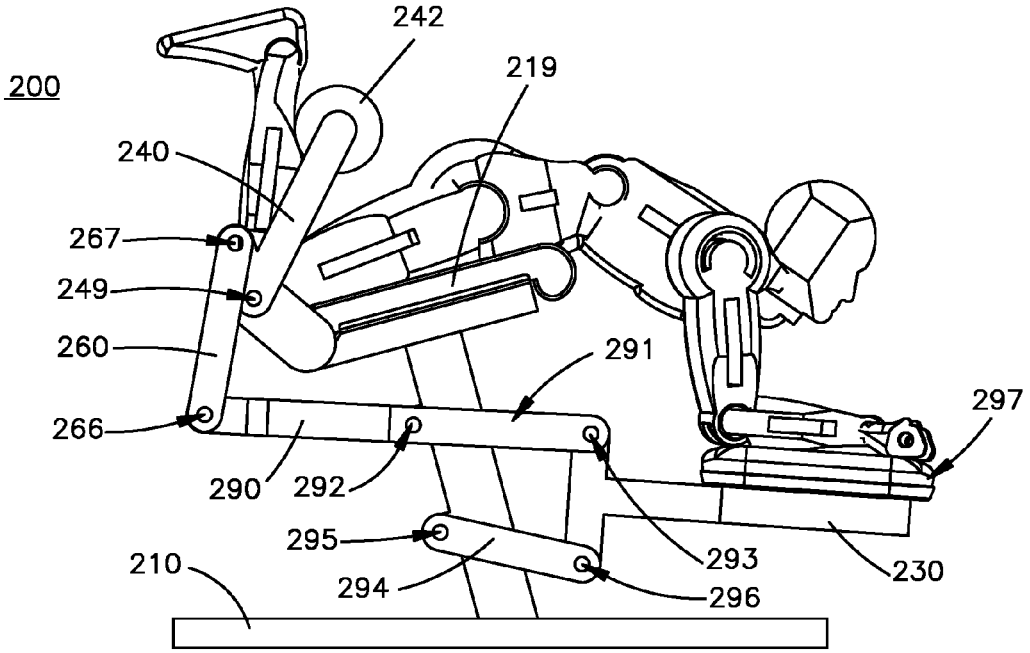
FIG. 12 is a right side view of an alternative embodiment of a leg curl exercise machine as depicted in FIG. 11, including a user in the exercise ending position, with the selectorized weight stack assembly omitted for clarity.
Figure 13:
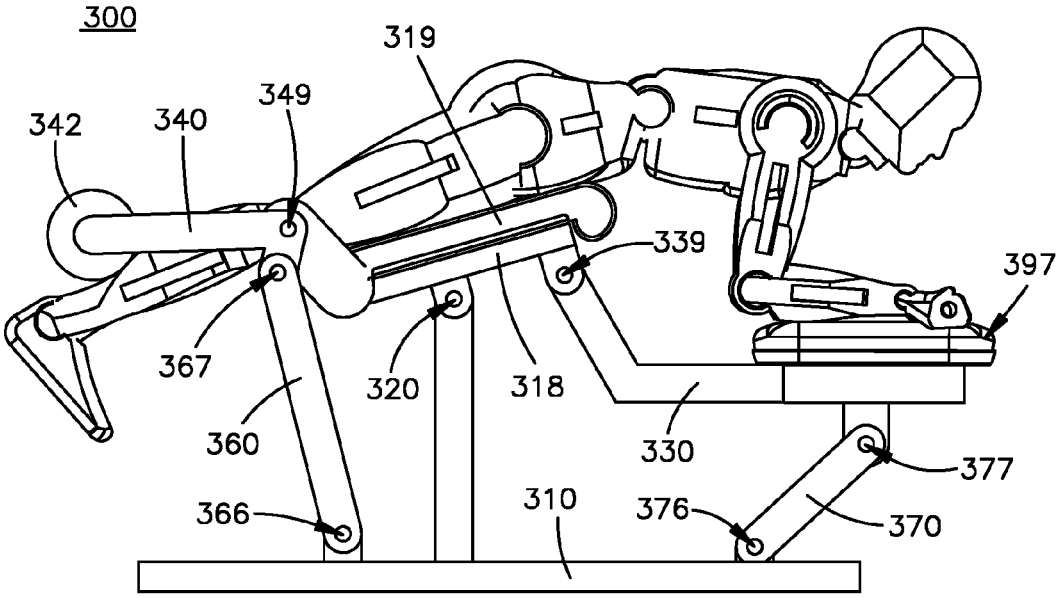
FIG. 13 is a right side view of an alternative embodiment of a leg curl exercise machine, including a user in the exercise starting position, with the selectorized weight stack assembly omitted for clarity.
Figure 14:
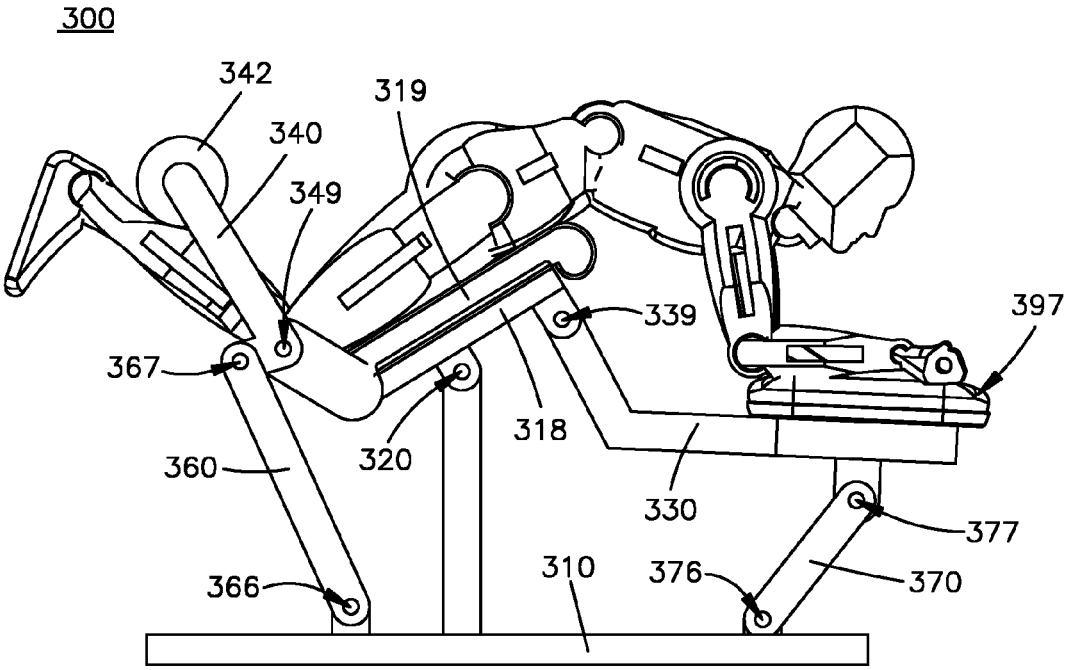
FIG. 14 is a right side view of an alternative embodiment of a leg curl exercise machine as depicted in FIG. 13, including a user in the exercise ending position, with the selectorized weight stack assembly omitted for clarity.
Figure 15:
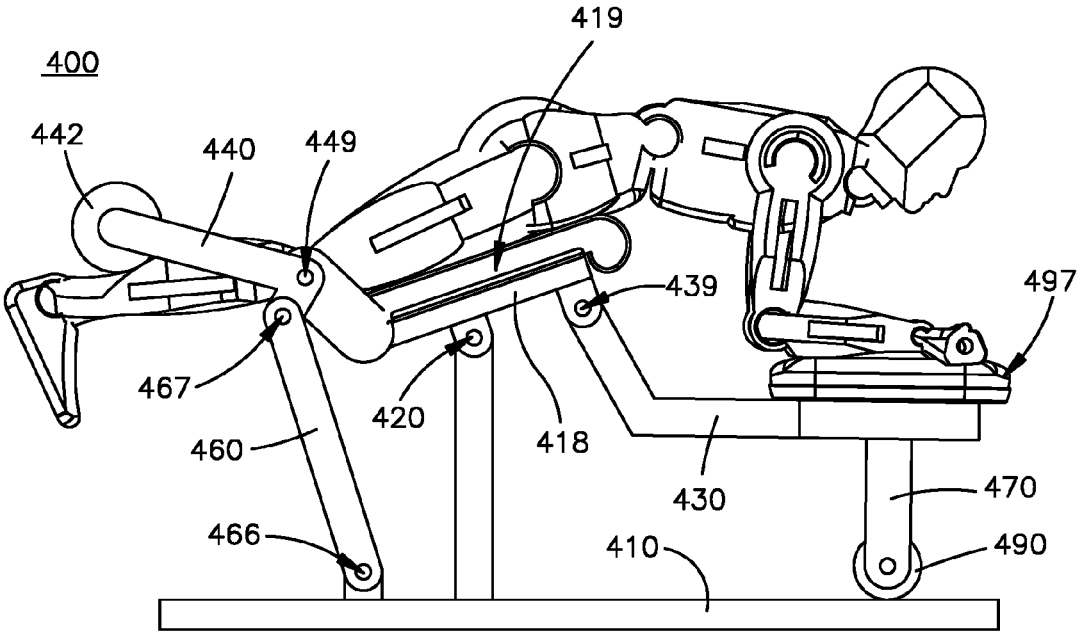
FIG. 15 is a right side view of an alternative embodiment of a leg curl exercise machine, including a user in the exercise starting position, with the selectorized weight stack assembly omitted for clarity.
Figure 16:
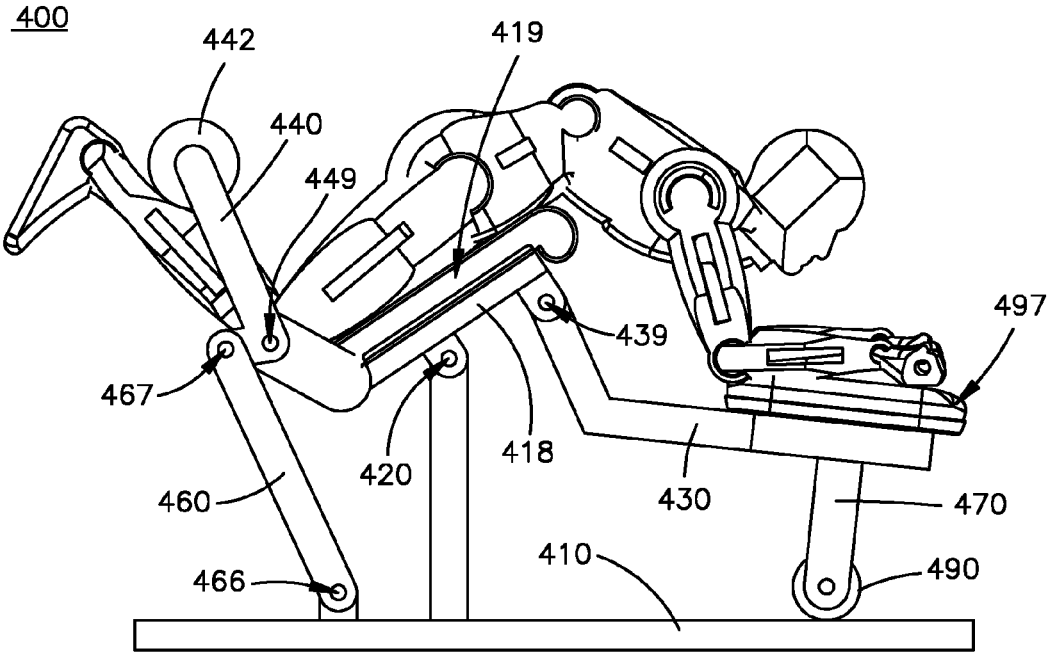
FIG. 16 is a right side view of an alternative embodiment of a leg curl exercise machine as depicted in FIG. 15, including a user in the exercise ending position, with the selectorized weight stack assembly omitted for clarity.

Additional embodiments of the present invention include leg curl exercise machines such as those depicted in FIGS. 11 and 12, in FIGS. 13 and 14, and in FIGS. 15 and 16. One of ordinary skill in the art will appreciate that FIGS. 11-16 and the accompanying descriptions are simplified to convey and enable the basic structure and operation of these embodiments, in light of the detailed description and drawings already provided with respect to the embodiment of FIGS. 1-10. The embodiments of FIGS. 11-16 may include any or all of the components and features described and depicted with respect to the embodiment of FIGS. 1-10. The present invention encompasses all such variations. Accordingly, the description of the embodiment of FIGS. 1-10 is expressly incorporated with respect to each of the embodiments shown in FIGS. 11 and 12, in FIGS. 13 and 14, and in FIGS. 15 and 16.

FIGS. 11 and 12 depict an additional embodiment of the present invention. FIG. 11 shows a leg curl exercise machine 200 in an exercise starting position, and FIG. 12 shows the embodiment in an exercise ending position. The embodiment of FIGS. 11 and 12 includes a main frame 210 supporting a stationary thigh pad 219. An exercise arm assembly 240 includes a roller pad 242 and is pivotally mounted to the main frame 210 for rotation about pivot axis 249. The exercise arm assembly 240 is pivotally connected to a connecting link 260 for relative rotation about pivot axis 267. The exercise arm assembly's 240 pivotal connection to the connecting link 260 may be direct, or alternatively, it may be indirect using an intervening cam assembly such as the cam assembly 150 previously described. The connecting link 260 is pivotally connected to a first member 291 for relative rotation about pivot axis 266. The first member 291 is pivotally connected to the main frame 210 for rotation about pivot axis 292, which is forward of pivot axis 266. The first member 291 is also pivotally connected to a moving support frame 230 at a location forward of pivot axis 292, for relative rotation about pivot axis 293. A second member 294 is pivotally connected to the main frame 210 for rotation about pivot axis 295. The second member 294 is also pivotally connected to the moving support frame 230 at a location forward of the pivot axis 295, for relative rotation about pivot axis 296. The main frame 210, first member 291, moving support frame 230, and second member 294 together form a four-bar linkage 290.

The moving support frame 230 is depicted in FIGS. 11 and 12 as including an arm rest pad 297. But those skilled in the art will appreciate that this embodiment may also utilize one or more chest pads, handles, or other means of supporting the user's upper torso that are understood in the art.

Referring still to FIGS. 11 and 12, the user's lower legs exert a force on the roller pad 242. In response, the roller pad 242 moves upwardly and forwardly in an arcuate path as the exercise arm assembly 240 rotates about pivot axis 249. As the exercise arm assembly 240 rotates about pivot axis 249, connecting link 260, which is pivotally connected to the exercise arm assembly (or to a cam assembly such as cam assembly 150) at pivot axis 267, is pulled upward. As the connecting link 260 moves upward, it lifts the rear end of first member 291, which is pivotally connected to the connecting link at pivot axis 266. As the rear end of first member 291 moves upward, it tilts about pivot axis 292, such that the front end of first member 291 moves downward. As the front end of first member 291 moves downward, the front end of second member 294 and the moving support frame 230 also move downward because the moving support frame 230 and the front ends of the first and second members 291, 294 are all coupled together through pivot axes 293, 296.

Thus, the moving support frame 230, including the arm rest pad 297, dips lower as the user completes a prone leg curl exercise, finishing in the exercise ending position shown in FIG. 12. As shown in FIG. 12, the user's upper torso moves downward as the arm rest pad 297 dips lower, thus avoiding any excessive arching or stressing of the user's lower back.

FIGS. 13 and 14 depict an additional embodiment of the present invention. FIG. 13 shows a leg curl exercise machine 300 in an exercise starting position, and FIG. 14 shows the embodiment in an exercise ending position. The embodiment of FIGS. 13 and 14 includes a main frame 310 supporting a tilting thigh pad frame 318 that is pivotally connected to the main frame for rotation about pivot axis 320. A thigh pad 319 is mounted on the tilting thigh pad frame 318. An exercise arm assembly 340 includes a roller pad 342 and is pivotally mounted to the tilting thigh pad frame 318 for relative rotation about pivot axis 349. The exercise arm assembly 340 is pivotally connected to a connecting link 360 for relative rotation about pivot axis 367. The exercise arm assembly's 340 pivotal connection to the connecting link 360 may be direct, or alternatively, it may be indirect using an intervening cam assembly such as the cam assembly 150 previously described. The connecting link 360 is pivotally connected to the main frame 310 for rotation about pivot axis 366. A moving support frame 330 is pivotally connected to the tilting thigh pad frame 318 for relative rotation about pivot axis 339. The moving support frame 330 is pivotally connected to a second connecting link 370 for relative rotation about pivot axis 377. The second connecting link 370 is pivotally connected to the main frame 310 for relative rotation about pivot axis 376.

The moving support frame 330 is depicted in FIGS. 13 and 14 as including an arm rest pad 397. But those skilled in the art will appreciate that this embodiment may also utilize one or more chest pads, handles, or other means of supporting the user's upper torso that are understood in the art.

Referring still to FIGS. 13 and 14, the user's lower legs exert a force on the roller pad 342. In response, the roller pad 342 moves upwardly and forwardly in an arcuate path as the exercise arm assembly 340 rotates. In the previously described embodiments, an exercise arm assembly rotates about a fixed pivot axis, pulling a connecting link upward. But the connecting link 360 of the leg curl exercise machine 300 cannot move upward because it is pivotally connected to the main frame 310 for rotation about pivot axis 366. Instead, exercise arm assembly 340 rotates about pivot axes 349 and 367, which both move relative to the main frame 310. Pivot axis 349 moves downward, along with the rear end of the tilting thigh pad frame 318. The tilting thigh pad frame 318 thus tilts as it rotates about pivot axis 320. Accordingly, the front end of the tilting thigh pad frame 318 moves upward. As the front end of the tilting thigh pad frame 318 moves upward, it lifts and draws rearward the rear end of moving support frame 330, which is pivotally coupled to the tilting thigh pad frame 318 for relative rotation about pivot axis 339. As the rear end of the moving support frame 330 moves rearward, the second connecting link 370, which is pivotally connected to the moving support frame 330 for rotation about pivot axis 377, rotates about pivot axis 376. This causes the front end of the moving support frame 330 to rise.

Thus, the tilting thigh pad frame 318 and thigh pad 319 tilt as the user completes a prone leg curl exercise, finishing in the exercise ending position shown in FIG. 14. At the same time, the moving support frame 330, including the arm rest pad 397, moves in an upward and rearward direction while also tilting slightly to end in the exercise ending position of FIG. 14. As shown in FIG. 14, the user's thighs, lower torso, and upper torso move in such a way as to avoid any excessive arching or stressing of the user's lower back.

FIGS. 15 and 16 depict an additional embodiment of the present invention. FIG. 15 shows a leg curl exercise machine 400 in an exercise starting position, and FIG. 16 shows the embodiment in an exercise ending position. The embodiment of FIGS. 15 and 16 is substantially similar to the embodiment of FIGS. 13 and 14, except that the moving support frame 430 is rigidly connected to a second connecting link 470 that includes a roller 490 that engages the main frame 410. In contrast, the embodiment shown in FIGS. 13 and 14 includes a second connecting link 370 pivotally connected to the main frame 310 for rotation about pivot axis 376 and to the moving support frame 330 for rotation about pivot axis 377.

More specifically, the embodiment of FIGS. 15 and 16 includes a main frame 410 supporting a tilting thigh pad frame 418 that is pivotally connected to the main frame 410 for rotation about pivot axis 420. A thigh pad 419 is mounted on the tilting thigh pad frame 418. An exercise arm assembly 440 includes a roller pad 442 and is pivotally mounted to the tilting thigh pad frame 418 for relative rotation about pivot axis 449. The exercise arm assembly 440 is pivotally connected to a connecting link 460 for relative rotation about pivot axis 467. The exercise arm assembly's 440 pivotal connection to the connecting link 460 may be direct, or alternatively, it may be indirect using an intervening cam assembly such as the cam assembly 150 previously described. The connecting link 460 is pivotally connected to the main frame 410 for rotation about pivot axis 466. A moving support frame 430 is pivotally connected to the tilting thigh pad frame 418 for relative rotation about pivot axis 439. The moving support frame 430 is rigidly connected to a second connecting link 470. The second connecting link 470 includes a roller 490 that engages the main frame 410 to allow the moving support frame 430 to move fore and aft and rotate relative to the main frame 410.

Those skilled in the art will recognize that alternative engagements between the second connecting link 470 are known within the art and are within the scope of the present invention. As a non-limiting example, the second connecting link 470 may slide along a surface on the main frame 410. Other means of enabling the desired movement between the moving support frame 430 and the main frame 410 will be readily apparent to those skilled in the art. Additionally, the moving support frame 430 is depicted in FIGS. 15 and 16 as including an arm rest pad 497. But those skilled in the art will appreciate that this embodiment may also utilize one or more chest pads, handles, or other means of supporting the user's upper torso that are understood in the art.

Referring still to FIGS. 15 and 16, the user's lower legs exert a force on the roller pad 442. In response, the roller pad 442 moves upwardly and forwardly in an arcuate path as the exercise arm assembly 440 rotates. The exercise arm assembly 440 rotates about pivot axes 449 and 467, which both move relative to the main frame 410. Pivot axis 449 moves downward, along with the rear end of the tilting thigh pad frame 418. The tilting thigh pad frame 418 thus tilts as it rotates about pivot axis 420. Accordingly, the front end of the tilting thigh pad frame 418 moves upward. As the front end of the tilting thigh pad frame 418 moves upward, it lifts and draws rearward the rear end of moving support frame 430, which is pivotally coupled to the tilting thigh pad frame 418 for relative rotation about pivot axis 439. As the rear end of the moving support frame 430 moves rearward, the second connecting link 470, which is rigidly connected to the moving support frame 430, moves rearward as well. This causes the roller 490 to travel rearward along the main frame 410.

Thus, the tilting thigh pad frame 418 and thigh pad 419 tilt as the user completes a prone leg curl exercise, finishing in the exercise ending position shown in FIG. 16. At the same time, the moving support frame 430, including the arm rest pad 497, moves in an upward and rearward direction while also tilting slightly to end in the exercise ending position of FIG. 16. As shown in FIG. 16, the user's thighs, lower torso, and upper torso move in such a way as to avoid any excessive arching of the lower back.

LIST OF REFERENCE NUMERALS 100-leg curl exercise machine
110-main frame
111-horizontal side strut
112-horizontal cross strut
113-support upright
114-support upright
115-vertical exercise arm support member
116-horizontal connecting strut
117-support foot
118-thigh pad frame
119-thigh pad
120-weight stack support strut
121-exercise arm support strut
122-moving support frame pivot bracket
123-moving support frame pivot bracket
124-exercise arm pivot bracket
125-pivot sleeve
130-moving support frame
131-moving frame member
132-chest pad
133-handle
134-axle
135-counterweight
136-pivot strut
137-pivot sleeve
138-pivot pin
139-pivot axis
140-exercise arm assembly
141-rotating exercise arm
142-roller pad
143-pivot sleeve
144-pull pin
145-roller pad support and pivot bracket
146-roller pad support rod
147-counterweight
148-pivot pin
149-pivot axis
150-cam assembly
151-cam
152-opening
153-exercise arm adjuster
154-adjustment opening
155-axle
160-connecting link
161-bent member
162-pivot sleeve
163-pivot sleeve
166-pivot axis
167-pivot axis
170-selectorized weight stack assembly
171-lifting rod
172-weight plate
173-guide rod
174-housing
175-aligned opening
176-pin
180-pulley assembly
181-first pulley
182-second pulley
183-third pulley
200-leg curl exercise machine
210-main frame
219-stationary thigh pad
230-moving support frame
240-exercise arm assembly
242-roller pad
249-pivot axis
260-connecting link
266-pivot axis
267-pivot axis
290-four-bar linkage
291-first member
292-pivot axis
293-pivot axis
294-second member
295-pivot axis
296-pivot axis
297-arm rest pad
300-leg curl exercise machine -continued

LIST OF REFERENCE NUMERALS 310-main frame
318-tilting thigh pad frame
319-thigh pad
320-pivot axis
330-moving support frame
339-pivot axis
340-exercise arm assembly
342-roller pad
349-pivot axis
360-connecting link
366-pivot axis
367-pivot axis
370-second connecting link
377-pivot axis
376-pivot axis
397-arm rest pad
400-leg curl exercise machine
410-main frame
418-tilting thigh pad frame
419-thigh pad
420-pivot axis
430-moving support frame
439-pivot axis
440-exercise arm assembly
442-roller pad
449-pivot axis
460-connecting link
466-pivot axis
467-pivot axis
470-second connecting link
490-roller
497-arm rest pad The list of reference numerals is provided for convenience and is intended to aid understanding of the illustrated embodiments described above. The embodiments of the present invention may be described in many different forms and should not be construed as limited to the illustrated embodiments. Likewise, the list above setting forth the reference numerals and associated components comprising the illustrated embodiments do not limit the scope of the invention as recited in the claims that follow.

We claim:

1. An exercise machine for performing prone leg curl exercises, comprising:

a stationary main frame;

a prone leg curl exercise arm assembly pivotally connected to the main frame for rotation about a first pivot axis, the prone leg curl exercise arm assembly including an exercise arm configured to move in an arcuate path between a lowered exercise starting position and a raised exercise ending position;

a moving support platform for supporting the user's upper torso, the moving support platform being pivotally connected to the main frame for rotation about a second pivot axis; and a connecting link pivotally connected to the prone leg curl exercise arm assembly for relative rotation about a third pivot axis, the connecting link pivotally connected to the moving support platform for relative rotation about a fourth pivot axis thereby tilting the moving support platform, wherein the connecting link translates movement of the prone leg curl exercise arm between the exercise starting position and the exercise ending position into a corresponding movement of the moving support platform such that the user's upper torso is tilted downwardly as the user's legs move to the raised exercise ending position.

2. The exercise machine according to claim 1, wherein the stationary main frame includes a user support pad.

3. The exercise machine according to claim 2, wherein the user support pad is a thigh pad.

4. The exercise machine according to claim 1 further comprising a source of resistance associated with at least one of the prone leg curl exercise arm assembly, the moving support platform, and the connecting link.

5. The exercise machine according to claim 4, wherein the source of resistance is a selectorized weight stack.

6. The exercise machine according to claim 5 further comprising a pulley assembly that transmits the resistance provided by the selectorized weight stack to the prone leg curl exercise arm assembly, biasing the prone leg curl exercise arm assembly toward the lowered exercise start position.

7. The exercise machine according to claim 1, wherein the moving support platform includes at least one user support pad.

8. The exercise machine according to claim 7, wherein the at least one user support pad is configured to support a chest of a user.

9. The exercise machine according to claim 8, wherein the at least one user support pad is a chest pad.

10. The exercise machine according to claim 7, wherein the moving support platform includes at least one handle for gripping by a user.

11. The exercise machine according to claim 10, wherein the moving support platform includes an elongated frame member having a first end and a second end opposite the first end.

12. The exercise machine according to claim 11, wherein the first end of the elongated frame member includes the at least one user support pad.

13. The exercise machine according to claim 12, wherein the moving support platform includes a counterweight at the second end of the elongated frame member, the counterweight configured to lightly bias the moving support platform toward the lowered exercise starting position.

14. The exercise machine according to claim 1, wherein as the exercise arm assembly moves from the lowered exercise starting position toward the raised exercise ending position, the moving support platform tilts relative to the stationary main frame.

15. The exercise machine according to claim 14, wherein the first axle is mounted on the exercise arm assembly.

16. The exercise machine according to claim 1, wherein as the exercise arm moves from the lowered exercise starting position toward the raised exercise ending position, the moving support platform moves downward relative to the stationary main frame.

17. The exercise machine according to claim 1 further comprising a first axle, which provides the pivotal connection between the connecting link and the exercise arm assembly, and which defines the third pivot axis.

18. The exercise machine according to claim 1 further comprising a second axle, which provides the pivotal connection between the connecting link and the moving support platform, and which defines the fourth pivot axis.

19. The exercise machine according to claim 17, wherein the second axle is mounted on the moving support platform.

20. The exercise machine according to claim 1, wherein the exercise arm assembly includes at least one roller pad for engaging the back of a user's lower leg.

21. The exercise machine according to claim 20, wherein the exercise arm includes a first end and a second end opposite the first end.

22. The exercise machine according to claim 21, wherein the first end of the exercise arm includes the at least one roller pad.

23. The exercise machine according to claim 22, wherein the exercise arm assembly includes a counterweight at the second end of the exercise arm, the counterweight configured to lightly bias the moving support platform toward the lowered exercise starting position.

24. The exercise machine according to claim 1 further, wherein the exercise arm assembly further comprises:

a cam assembly including a cam pivotally connected to the stationary main frame for rotation about the first pivot axis and a plurality of adjustment openings associated with the cam; and a pull pin associated with the exercise arm, the pull pin configured to selectively engage one or more of the adjustment openings, wherein selective engagement of the pull pin into one or more of the adjustment openings couples the cam assembly and the exercise arm for synchronized rotation about the first pivot axis.

25. The exercise machine according to claim 24, wherein the pull pin may be selectively engaged into one or more of the adjustment openings in order to adjust the exercise starting position of the exercise arm.

26. The exercise machine according to claim 25 further comprising an exercise arm adjuster mounted on the cam, wherein the exercise arm adjuster includes the plurality of adjustment openings.

27. The exercise machine according to claim 25 further comprising a first axle mounted on the cam, wherein the first axle provides the pivotal connection between the connecting link and the exercise arm assembly, and wherein the first axle defines the third pivot axis.

* * * * *